United States Patent [19]

Höppe et al.

[11] Patent Number: 4,848,308

[45] Date of Patent: Jul. 18, 1989

[54] STONEWORKING OR CUTTING DEVICE

[75] Inventors: Olaf Höppe, Emerkingen; Helmut Schmid, Hausen; Peter Reinschütz, Munderkingen; Karl Weggenmann, Oberstadion, all of Fed. Rep. of Germany

[73] Assignee: Betonwerke Munderkingen GmbH, Munderkingen, Fed. Rep. of Germany

[21] Appl. No.: 142,781

[22] Filed: Jan. 11, 1988

[30] Foreign Application Priority Data

Jan. 12, 1987 [DE] Fed. Rep. of Germany ..... 3700676
Jun. 16, 1987 [DE] Fed. Rep. of Germany ..... 3720179

[51] Int. Cl.[4] ..... B28D 1/22

[52] U.S. Cl. ..... 125/7; 125/6; 125/29

[58] Field of Search ..... 125/6, 7, 29; 173/122, 173/117; 299/37; 404/90

[56] References Cited

U.S. PATENT DOCUMENTS 420,185 1/1890 Chapman ..... 125/29
1,287,346 12/1918 Krom ..... 125/7
3,139,944 7/1964 Smith ..... 173/122
3,633,973 1/1972 Chesterman ..... 299/37
3,851,921 12/1974 Makishima ..... 299/37
3,904,245 9/1975 Clarke ..... 125/7

FOREIGN PATENT DOCUMENTS 5043 5/1879 Fed. Rep. of Germany .
2359913 6/1975 Fed. Rep. of Germany .

*Primary Examiner*—Frederick R. Schmidt
*Assistant Examiner*—Maurina Rachuba
*Attorney, Agent, or Firm*—Nils H. Ljungman

[57] ABSTRACT

A stoneworking or cutting device for texturing the surface of stones, in particular, concrete slabs, has a tool holder in a swing frame with a number of stoneworking or cutting tools, whereby each tool is activated individually. To produce the striking force, a number of flyweights are mounted on the swing frame so that they can rotate, whereby the swing frame itself is mounted so that its height can be adjusted in a horizontally movable base carriage. Striking pins corresponding to the individual tools in the tool holder are made to oscillate by the flyweights to activate the tools which work the stone.

20 Claims, 6 Drawing Sheets

STONEWORKING OR CUTTING DEVICE

BACKGROUND OF THE INVENTION

1. Field of the Invention:

This invention relates to a stoneworking or cutting device and in particular, to a device for texturing stone surfaces, whereby a number of stoneworking or cutting tools are located in a common tool holder, the height of which can be adjusted, and wherein each tool is individually activated.

2. Description of the Prior Art:

In stoneworking or cutting, surface texturing is known in the prior art. For this purpose, certain tools of the prior art known as texturing chisels are used, which are used not only manually, but also in conjunction with stoneworking or cutting machines. As a rule, one or more chisels are housed in an apparatus and are driven either mechanically, pneumatically or electrically. This surface treatment is conducted not only on products consisting of natural stone, but also on concrete, where the devices are used to produce simulated surfaces which have the character of a natural surface worked by hand by a stonemason.

Stoneworking or cutting devices for working stone surfaces with a number of stoneworking or cutting tools in a common tool holder, the height of which is adjustable, have long been part of the prior art, as described in German Patent No. DE-PS 5 043 and 60 870, both of which are incorporated herein by reference as if the entire contents thereof were fully set fourth herein. In these devices, a number of stoneworking or cutting tools are arranged in a row next to one another and individually mechanically activated. The stone surface to be worked is moved horizontally underneath the stoneworking or cutting tools. Stone surfaces worked with such devices exhibit a regular and repeating structure, since the tool holder cannot be moved horizontally.

For this reason, the prior art also includes a stoneworking or cutting tool with one or more stone chisels which can be moved horizontally on an overhead transporter structure. During operation, these tools are moved transverse to the direction of travel of the stone being worked. As a result of the unavoidable vibrations which occur during operation, as a rule only one stoneworking or cutting tool with a single chisel can be installed on the above-mentioned overhead transporter structure. Therefore, the working of large stone surfaces is extremely time consuming.

OBJECT OF THE INVENTION

One object of the present invention is the provision of a stoneworking or cutting device to work the surface of concrete, in particular, concrete paving blocks, which simulates natural stone worked by hand by a stonemason, and by means of which it is simultaneously possible to work a large surface area with a number of individual tools in a random distribution.

SUMMARY OF THE INVENTION

This object is achieved by using a number of tools housed in a stoneworking or cutting apparatus in a common, vertically adjustable tool holder, whereby each tool is activated individually. The tool holder consists of a swing frame and a tool block fastened to it, with a number of flyweights mounted on the swing frame. The swing frame is mounted in a horizontally movable base carriage, and in the tool block, a tool plate carries a number of tools loosely held in holes distributed in a specified grid pattern, and these tools are activated by striking pins set in motion by the flyweights.

With a stoneworking or cutting device configured according to the invention, stone surfaces, in particular, concrete surfaces, can be extensively worked so that the desired impression of a handworked stone surface is achieved, whereby a finer or coarser surface structure can be achieved by an appropriate adjustment of the working intensity by means of the forward speed of the stone and the vertical adjustment of the swing frame, as well as its horizontal oscillation amplitude.

To introduce the vertical striking force, the swing frame is equipped on its upper side with guide bolts, which are mounted in guide sleeves on the base carriage. Mounted on the base carriage are connecting rods with bearings so that they can pivot on one end, and with a bearing for flyweight shafts on their other end. These flyweight shafts connected to the swing frame are themselves connected by means of cams in the other end of the connecting rods. Preferably, two flyweight shafts are used, which are driven so that the flyweights fastened to them rotate in directions opposite one another. As a result of the counter rotation of the flyweight shafts and their eccentric position in the connecting rods, the flyweights in contrary motion produce a controlled oscillation, as a result of which striking pins housed in the tool block are moved up and down, striking the individual, irregularly distributed tools guided in the tool plate. As a result of the vertical adjustment of the swing frame above the stone to be worked, the force with which the striking pin strikes the tool can be adjusted.

It has been shown in the operation of such a stone working or cutting device that the tuning (or harmonization) of the masses which participate in the movement is relatively critical, if the masses of the flyweight are not carefully tuned to the mass of the swing frame with the other masses fastened to it, as well as the mass of the tool block. Undesirable consequences of improper tuning of the masses are resonance phenomena, which also include the base frame of the equipment, in particular if, to change the working or cutting depth, the rotational speed of the flyweights is changed. These resonance phenomena are manifested particularly in the form of undesirable transverse oscillations of the base carriage.

Since, depending on the type of surface working and the size of the stone surface to be worked, tool blocks are used which have different widths and lengths, and thus different masses, it would be necessary to use replaceable flyweights to achieve even an approximate equilibrium. In practical applications, however, this measure is not feasible.

In one configuration of the invention, the tool block has a number of perpendicular holes corresponding to the specified grid pattern, in which the stricking pins are guided and prestressed by a spring against the tool in question. This prestressing by the spring is maintained by a cover which closes the hole.

Special chisels can be used as the tools in the holes of the tool plate. In a particularly advantageous configuration however, the tools consist of steel nails, which are placed in the tool plate so that their heads are in countersunk expansions of the holes in the tool plate. With such bits, e.g., made of steel nails, uneven spots in the rock can be smoothed out, and above all, the bevels on the edges of the rock can be worked just as well as the horizontal surfaces.

To increase the irregularity of the working of the rock surface by the cutting bits or steel nails, the holes in the tool plate are also countersunk from the outside of the plate so that there remains only a short segment of the hole which corresponds to the diameter of the bit or the nail. By shortening the guided length of the steel nail or the cutting bit, there is a larger lateral play, and the occurrence of patterns during the working can be avoided.

For working large surface areas of concrete paving blocks transported in series through the working device, a special configuration of the invention provides that the grid pattern of the holes for the cutting bits or steel nails in the tool block consists of a field with at least four rows and more than 20 holes in a row, whereby the holes are offset from row to row by approximately $\frac{1}{3}$ to $\frac{1}{4}$ of the distance between holes.

To set the horizontal oscillation amplitude of the swing frame, the base carriage is mounted so that it can move on horizontal shafts, so that the base carriage executes an oscillating movement with a stroke equal to at least one-half the distance between adjacent tools or cutting bits.

The shafts supporting the base carriage are mounted on oscillating bearings, which can be moved vertically together with the vertical carriage located in the frame, so that the tool holder on the swing frame can be adjusted as a function of the thickness of the stone.

In general, the invention features an apparatus for stoneworking, the stoneworking apparatus comprising: a base frame; an arrangement for providing relative translational movement in a first direction between the base frame and a stone to be worked; a swing frame, the swing frame being translatable in a second direction with respect to the stone to be worked; the first and the second directions being substantially non-aligned; the swing frame being provided with a tool block; the tool block being provided with stoneworking tool mounting apparatus for mounting a plurality of stoneworking tools in the tool block; an oscillating movement arrangement for imparting an oscillating movement to the swing frame so as to provide movement of the tool block and impinge the tool block against the stone to be worked; and a mechanical power source arrangement for powering and driving the oscillating movement arrangement.

In one aspect, the invention features an apparatus for stoneworking, the stoneworking apparatus comprising: a base frame; a swing frame, the swing frame being horizontally displaceable with respect to the base frame; the swing frame being provided with a tool block; the tool block being provided with plural stoneworking tool mounting arrangement for mounting a plurality of stoneworking tools in the tool block; and a vertically oscillating movement arrangement for imparting a vertically oscillating movement to the swing frame so as to provide movement of the tool block and impinge the tool block against the surface of a stone to be worked.

The advantages and characteristics of the invention will be described in greater detail below, with reference to one embodiment, the claims and the accompanying drawings.

DESCRIPTION OF THE PREFERRED EMBODIMENTS

Figure 1:
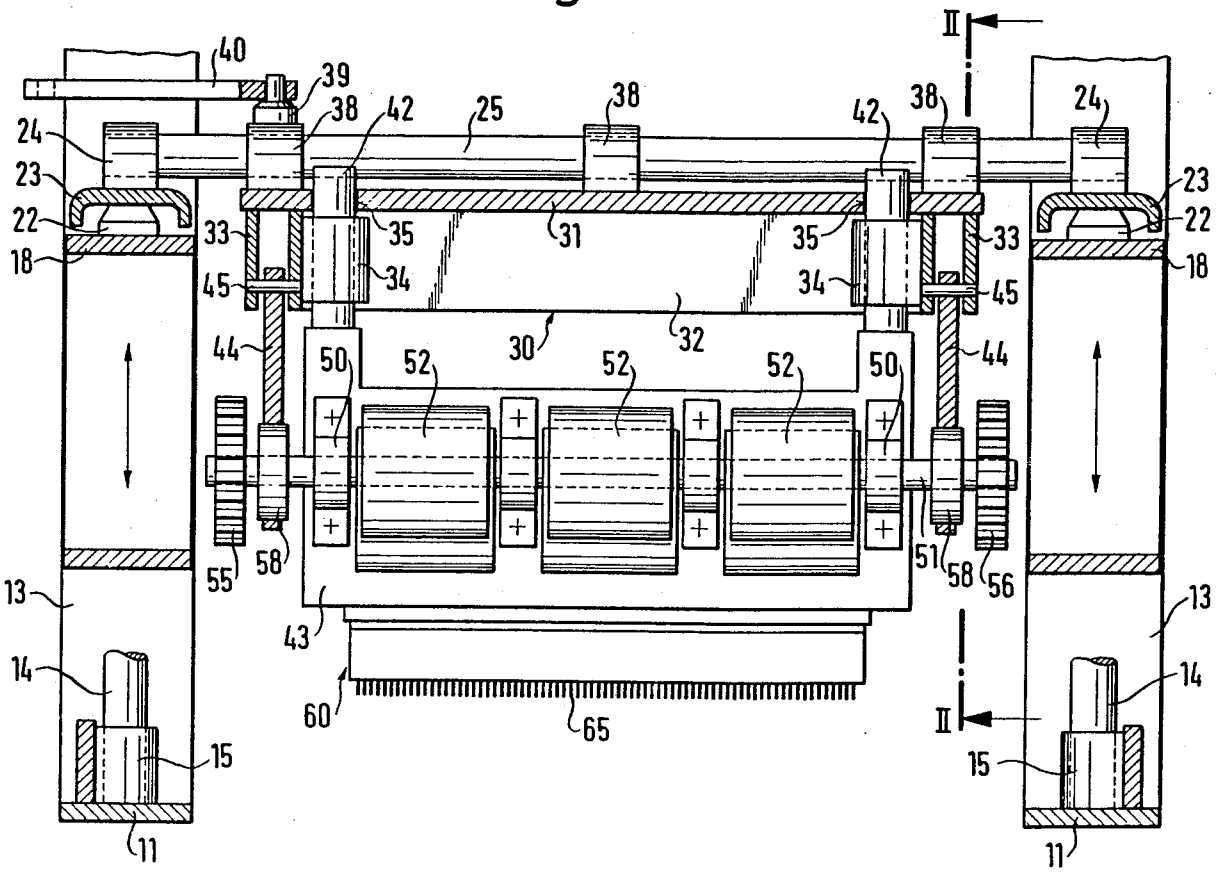
FIG. 1 is a side view in partial section of a stoneworking or cutting device according to the invention.
Figure 3:
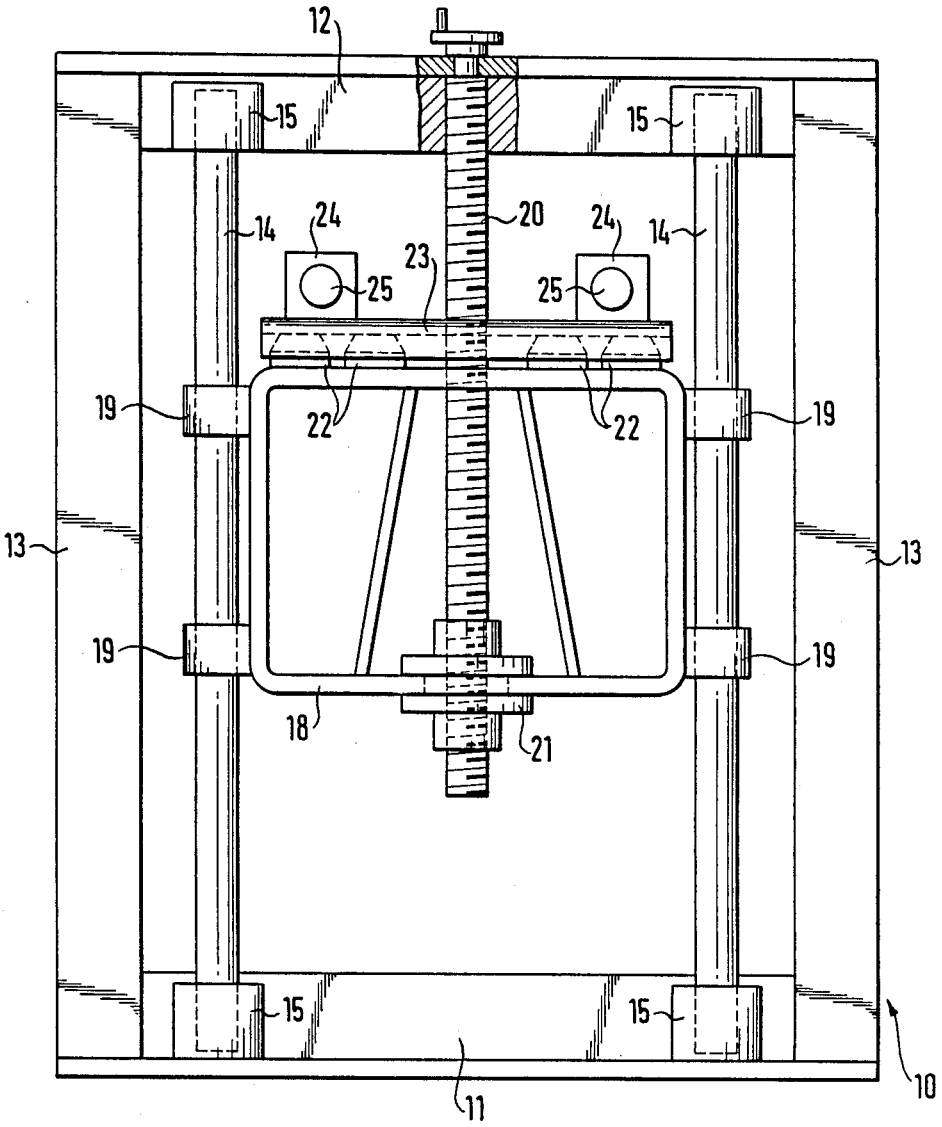
FIG. 3 is a head-on view of one of the lateral vertical carriages in the frame of the stoneworking or cutting device.

As shown in FIGS. 1 and 3, the stoneworking or cutting device according to the invention is installed in a frame 10, which consists of uprights 13 connected by a lower crossbeam 11 and an upper crossbeam 12. From the upper crossbeam to the lower crossbeam, guide rods 14 run parallel to the uprights 13, and are fastened to the crossbeams 11 and holders 15. Inside the frame 10 there is a vertical carriage 18, the vertical position of which is adjustable. For this purpose, guide sleeves 19 are attached to the frame-like vertical carriage on both sides, which can be moved on the guide rods 14. By means of a spindle 20 mounted in the upper crossbeam, which runs downward through the vertical carriage 18 and is bolted in the lower portion of the vertical carriage into a flanged nut 21, the vertical carriage 18 can be set to any desired height.

Fastened to the upper side of the vertical carriage 18 are several oscillating bearings (or shock mounts) 22, which can be hydraulic bearings, for example. Attached to the upper side of the oscillating bearing 22 is a bed plate 23. On its upper side, symmetrical to the spindle 20, this bed plate supports two clamps 24.

To erect the stoneworking or cutting unit itself, two identical base frames 10 are set at some distance from one another and connected to one another by means of shafts 25, which are fixed in the clamps 24. The stoneworking or cutting unit itself is mounted on these shafts 25 so that it can be moved horizontally.

Figure 2:
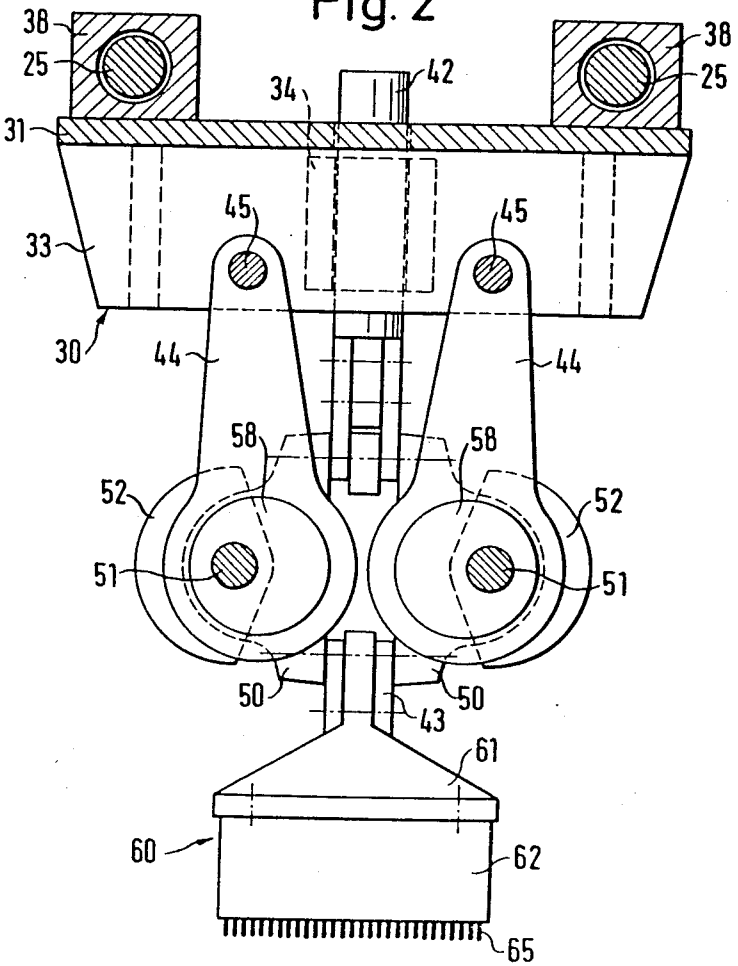
FIG. 2 is a section along line II—II in FIG. 1.

As shown in FIGS. 1 and 2, the stoneworking or cutting unit consists of a base carriage 30, which consists of a base plate 31 and a reinforcement frame 32 projecting downward. Bearing webs 33 run parallel to the lateral surfaces of the reinforcement frame 32. On the inside of the edges of the reinforcement frame 32, guide sleeves are attached in the middle. Above the guide sleeves 34, the base plate 31 has a hole 35.

On the upper side of the base plate 31, parallel to the edges and at a distance from it corresponding to the distance of the shafts 25, there are additional guide sleeves 38, through which the two shafts 25 run. Thus, the base carriage 30 can be moved horizontally on the shafts 25 between the base frames 10. Fastened to one of the guide sleeves 38 is a driver 39, to which a thrust rod 40 is coupled, on the free end of which a crank (see FIG. 7) acts, to induce the horizontal oscillating movement necessary to work or cut a stone. Through the guide sleeves 34 and the holes 35 run guide bolts 42, which are fastened to a swing frame 43. This swing frame is suspended by connecting rods 44 on the base carriage 30. The rods are required for the control of the vertical movement of the swing frame 43, as explained below.

Figure 6:
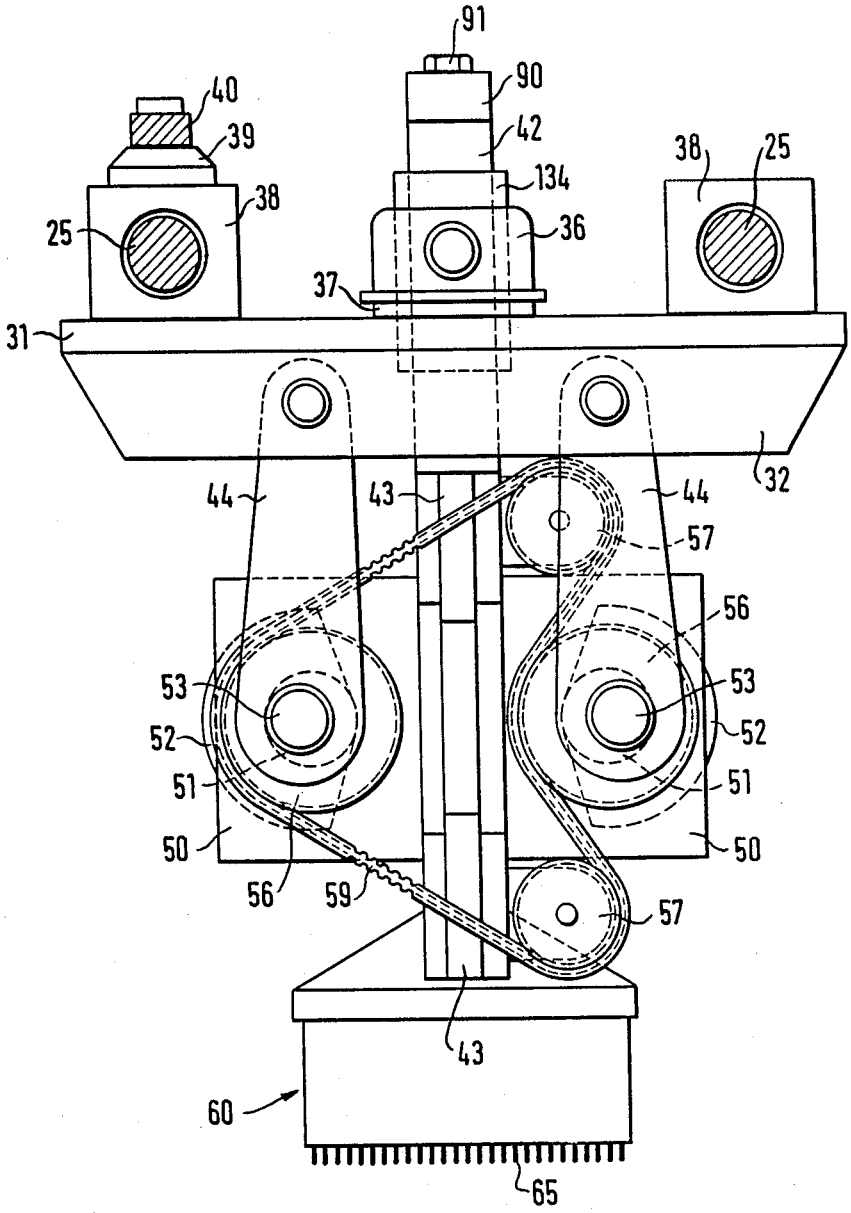
FIG. 6 is a head-on sectional view of the embodiment of FIG. 5, showing an alternative mechanism for converting the rotation of the flyweight shafts to a vertically oscillating movement of the swing frame, and showing synchronizing belt drive for synchronizing the opposite rotation of the flyweight shafts.

The swing frame 43 extends over the entire working width and has on both ends roller bearings 50, in which, on each side, a flyweight shaft is mounted. Fastened to the flyweight shafts 51 between the individual roller bearings 50 there are flyweights 52. The latter are mounted on the shafts as shown in FIG. 2, so that they are symmetrical to the center plane through the swing frame 43 and the guide bolts 42. The flyweight shafts 51 are driven on the one side by means of a toothed belt drive wheel 55, and are connected to one another on the other side of the swing frame by means of spur gears 56, so that they execute an opposite and symmetrical rotational movement, which introduces a controlled vertical oscillation into the swing frame as a result of the action of the flyweights. Flyweight shafts 51 may be synchronized in opposite rotational movement through the provision of an intermeshing gear assembly such as are well known in the art (see FIG. 7) or through the provision of a toothed belt drive such as is shown in FIG. 6.

The vertical oscillation is controlled by means of the connecting rods 44, which are interconnected with the flyweight shafts 51 by means of a rigid connection to a cam 58. Cam 58, which is of disc shape and is eccentrically connected to flyweight shaft 51, is rotatably mounted within connecting rod 44. As a result of this eccentric mounting of the flyweight shafts 51 in the connecting rods 44, the swing frame 43 is forced to execute a vertical oscillating movement relative to the base carriage 30, whereby the swing frame is guided by the guide bolts 42 and the guide sleeves 34 in the base carriage 30.

It will be appreciated by those skilled in the art that the eccentric connection of the of flyweight shaft 51 to cam 58 and the rotational connection of cam 58 to connecting rod 44 constitutes a rotational to linear conversion device for converting the rotation of flyweight shaft 51 to a vertically oscillating linear movement induced in swing frame 43.

Fastened along the lower edge of the swing frame 43 is a tool block 60, in which the cutting bits and striking pins are installed, which as a result of the vertical oscillating movement of the swing frame 43, execute a movement of their own and strike the tools with force.

Figure 4:
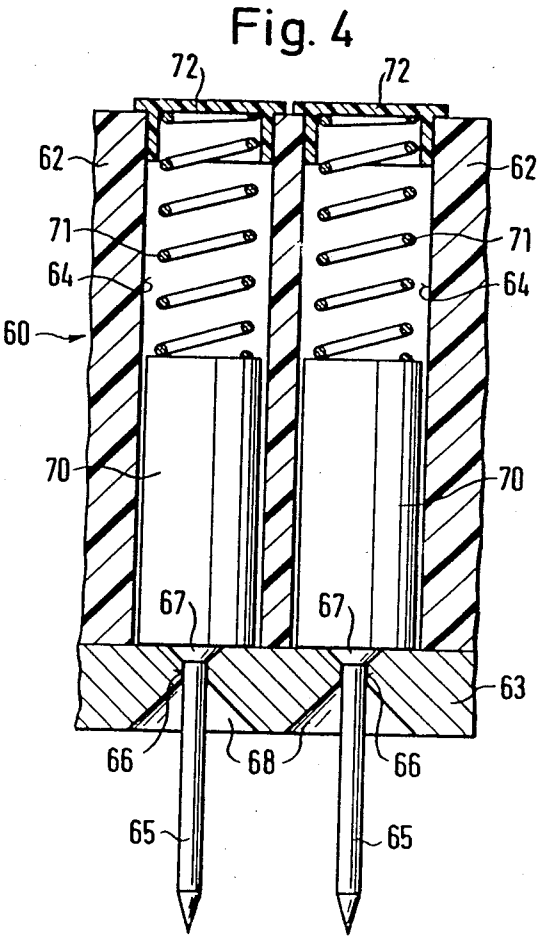
FIG. 4 is a partial section through the tool block.

FIG. 4 is a partial section through the tool block 60, showing the structure of the working tool in particular. The tool block consists of a mounting plate 61, which is fastened along the lower edge of the oscillating frame 43. Bolted against the mounting plate is the tool holder itself, which consists of a plate block 62 and a tool plate 63. The plate block 62 is preferably made of plastic, e.g., polyamide, and has a number of holes 64 distributed uniformly over the plate block. The holes are preferably in grid pattern, which consists of at least four rows with more than 20 holes. In a preferred embodiment, there are two grids with a total of 8 rows and approximately 25 holes in each row. The individual holes are offset from one another from row to row, by less than the distance between the holes. An offset in an interval of approximately $\frac{1}{3}$ to $\frac{1}{4}$ of the distance between holes has proven to be particularly advantageous. By selecting the distance between the individual holes, it is possible to influence the fineness of the working, so that, depending on whether a finer or coarser working is desired, the distance between holes can be selected smaller or larger. The tool plate attached to the underside of the plate block 62 has holes in the same grid pattern as the plate block 62. These holes fit the tools used which, for example, can be cutting or working bits in the form of steel nails 65. When such steel nails 65 are used, the holes 66 in the tool plate 63 on the side facing the plate block are countersunk so that the head 67 at the upper end of the steel nail 65 is completely inside the countersunk portion. In addition, the holes 66 are countersunk from the underside of the tool plate so that only a short segment remains which equals the diameter of the working or cutting bit or the steel nail. As a result of this measure, the steel nails can move freely in the hole 66 with a certain lateral play, which is particularly advantageous for the desired textured surface of the stone, and also for the service life of the working or cutting bits.

The application of force to the steel nails or the working pins is by means of longitudinally movable striking pins 70 in the holes 64, which are designed as heavy steel bodies and have a length of approximately one-half the height of the plate block 62. Above the striking pins, compression springs 71 are placed in the holes 64 and are held in the holes 64 by means of covers 72. These covers 72 are stressed against the mounting plate 61, when the plate block 62 is bolted to the latter.

As a result of the introduction of the vertical oscillation in the swing frames 43, the striking pins 70 in the holes 64 are moved up and down in the holes 64, and strike the steel nails 65, which are pushed back up by the stone to be worked, which is moving past and underneath the tool block 60, so that the striking pins 70 moving up and down, strike the heads 67 of the individual steel nails directly.

It is apparent that the height of the tool block 60 above the stone to be worked, which can be adjusted by means of the vertical carriages 18, is of essential importance for the intensity of working, so that the height of the surface texture can be set. Another influence on the working intensity and thus, on the texture of the stone surface, results from the horizontal oscillation amplitude of the base carriage 30 and the frequency of the osicillating movement. Finally, the third factor which has an effect is the speed of forward movement of the stone to be worked. As a result of the use of working or cutting bits or steel nails which can move freely individually and a suitable harmonization of the above mentioned factors, the surface of concrete paving blocks or slabs can be worked so that they give the appearance of a natural stone surface or one that has been worked by hand by a stonemason. Uneven spots in the stone can also be smoothed out, and above all, the bevelled edges of the stones can be smoothed out, and above all, the bevelled edges of the stones can be worked as well as the horizontal surfaces.

As described above, the texture of the surface can easily be varied within broad limits by adjusting the three important factors for the intensity of the cutting or working. An additional variation capability can be obtained by using different tool blocks, in which both the distance between the cutting or working bits and their diameter differs, as well as the weight of the striking pins.

The only parts of the working apparatus which are subject to wear are the cutting or working bits or steel nails, which must be replaced from time to time. For this purpose, the plate block 62 is unbolted from the mounting plate 61 and the covers are removed from those holes which contain the cutting or working bits or steel nails to be replaced. After the extraction of the compression springs 71 and the striking pins 70, the steel nail or bit can easily be replaced. After replacement, the striking pins and compression springs are reinstalled and the hole 64 is closed by the cover 72.

The invention is particularly advantageous not only for working very heavy concrete blocks, e.g., concrete paving blocks, but also relatively thin slabs which can be very easily broken during mechanical cutting or working. As a result of the very dense working of the stone surface over a very wide area, no extreme spot forces are exerted on the material, so that the danger of breaking is significantly reduced, particularly for slabs.

Figure 5:
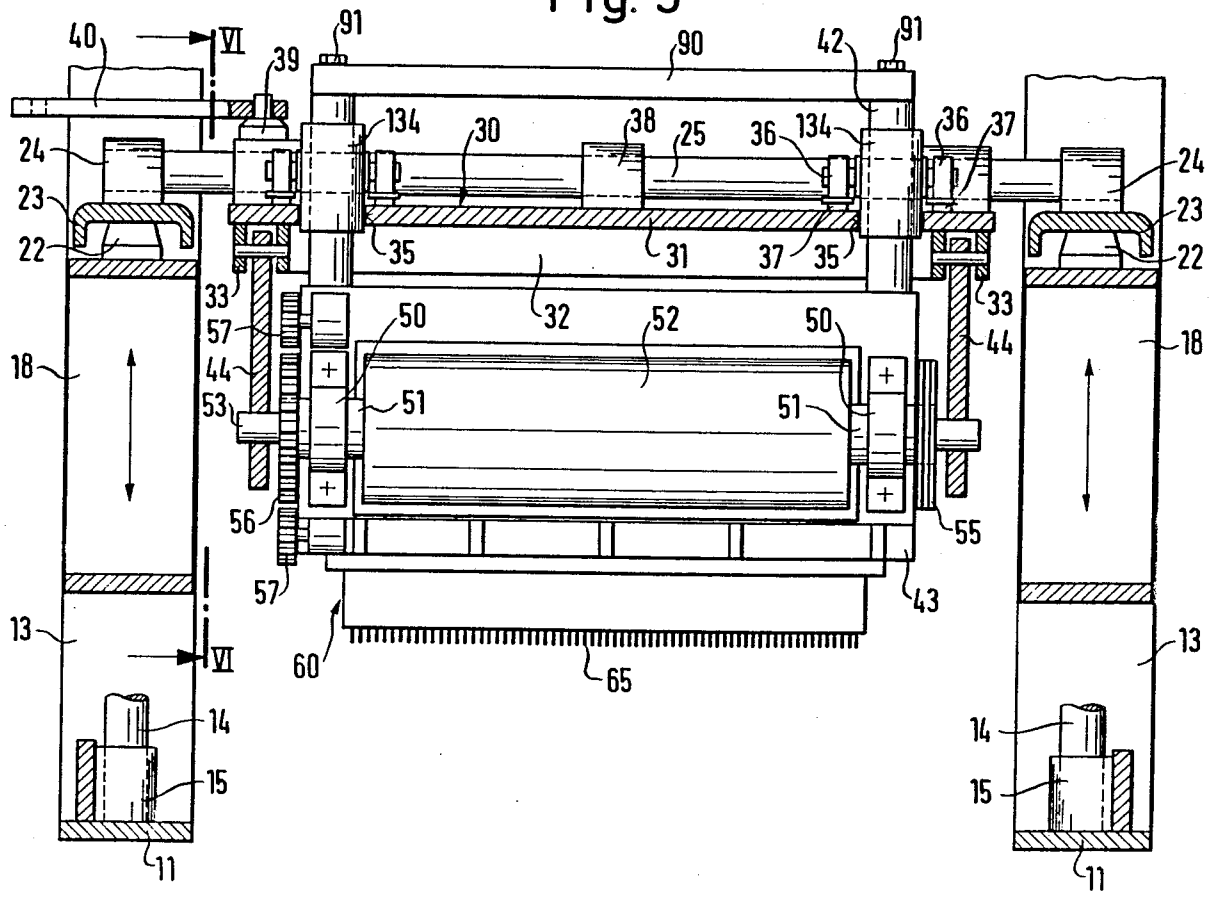
FIG. 5 is a side view of an alternate embodiment of a stoneworking device according to the invention.

We turn now to FIGS. 5 and 6 which show an alternate embodiment of a stoneworking apparatus constructed according to the invention.

Inasmuch as the embodiment shown in FIGS. 5 and 6 is similar to the embodiments shown in FIGS. 1–4, only the substantial differences between the construction of the two embodiments will now be described, and reference may be had to the above description of FIGS. 1–4 for further details common to both embodiments The stoneworking or cutting device illustrated in FIGS. 5 and 6 is mounted in a base frame, which consists of uprights 13, connected with a lower crossbeam 11 and an upper crossbeam (not shown).

Running from the upper to the lower crossbeam, parallel to the uprights 13, are guide rods 14, which are fastened in holders 15 at the top and bottom.

Inside the reinforcement frame 32, in the base plate 31 of the base carriage 30, there are holes 34, into which self-aligning sleeves 134 project. For the swivel mounting of the self-aligning sleeves 134, on the upper side of the base carriage, on both sides of the hole 34 in question, bearings 36 are mounted on swivel bearings, in which the pivots opposite one another of the self aligning sleeve 134 are held so that they can swivel.

The swing frame 43 extends over the entire working width and has on both sides roller bearings 50, in which a flyweight shaft 51 is mounted, on each side of the swing frame. This flyweight shaft is rigidly connected with a flyweight 52. By means of the roller bearings 50, the flyweights are mounted so that they are symmetrical to the center plane through the swing frame 43 and the guide bolts 42, as shown clearly in FIG. 6. The flyweight shafts are driven on the right side in the drawings by a V-belt wheel 55, and are connected to one another on the other side of the swing frame by means of a dual toothed belt drive, so that they execute an opposite and symmetrical rotational movement, which, by the action of the flyweight, induces a controlled vertical oscillation in the swing frame.

In the present embodiment, as shown most clearly in FIG. 6, connecting rods 44 are not provided with an internal cam (such as was the case with cam 58 in FIG. 2). Rather, flyweight shafts 51 are provided with eccentric ends or studs 53 which engage connecting rods 44. Rotation of flyweight shafts 51 in connecting rods 44 induce a sidewards oscillatory movement in connecting rods 44, which translates into a vertically oscillating movement of swing frame 43.

The dual toothed belt drive used to synchronize rotation is shown in FIG. 6.

This drive comprises two spur gears 56 and two idle spur gears 57, which are fastened above and below the flyweight on one side of the swing frame.

The toothed belt is guided by a spur gear 56 on the one idle spur gear 57, and deflected around the second spur gear 56, so that the latter executes a rotational movement opposite to that of the first spur gear. From the second spur gear 56, the toothed belt runs back over the second idle spur gear 57 to the first spur gear 56. The use of such a toothed belt ensures synchronization of the two flyweights, and the low flexibility of the toothed belt also has a favorable effect.

Depending on the size of the stone surfaces and the type of working, different tool blocks 50 can be used, which have different masses. The mass of the oscillating portion in relating to the weight of the flyweights is thereby changed, which has a disadvantageous effect if the mass equilibrium is disrupted. To compensate for the changes in mass, the invention therefore proposes that there be a compensation weight on the upper side of the guide bolt 42 in the form of a beam weight 90, which can weigh different amounts, and is fixed to the guide bolts by means of screws 91. By means of different beam weights it is possible to harmonize the mass of the swing frame and of the tool block and the parts fastened to it in relation to the weight of the flyweights, and to make the desired weight compensation, without having to change the mass of the flyweights.

Figure 7:
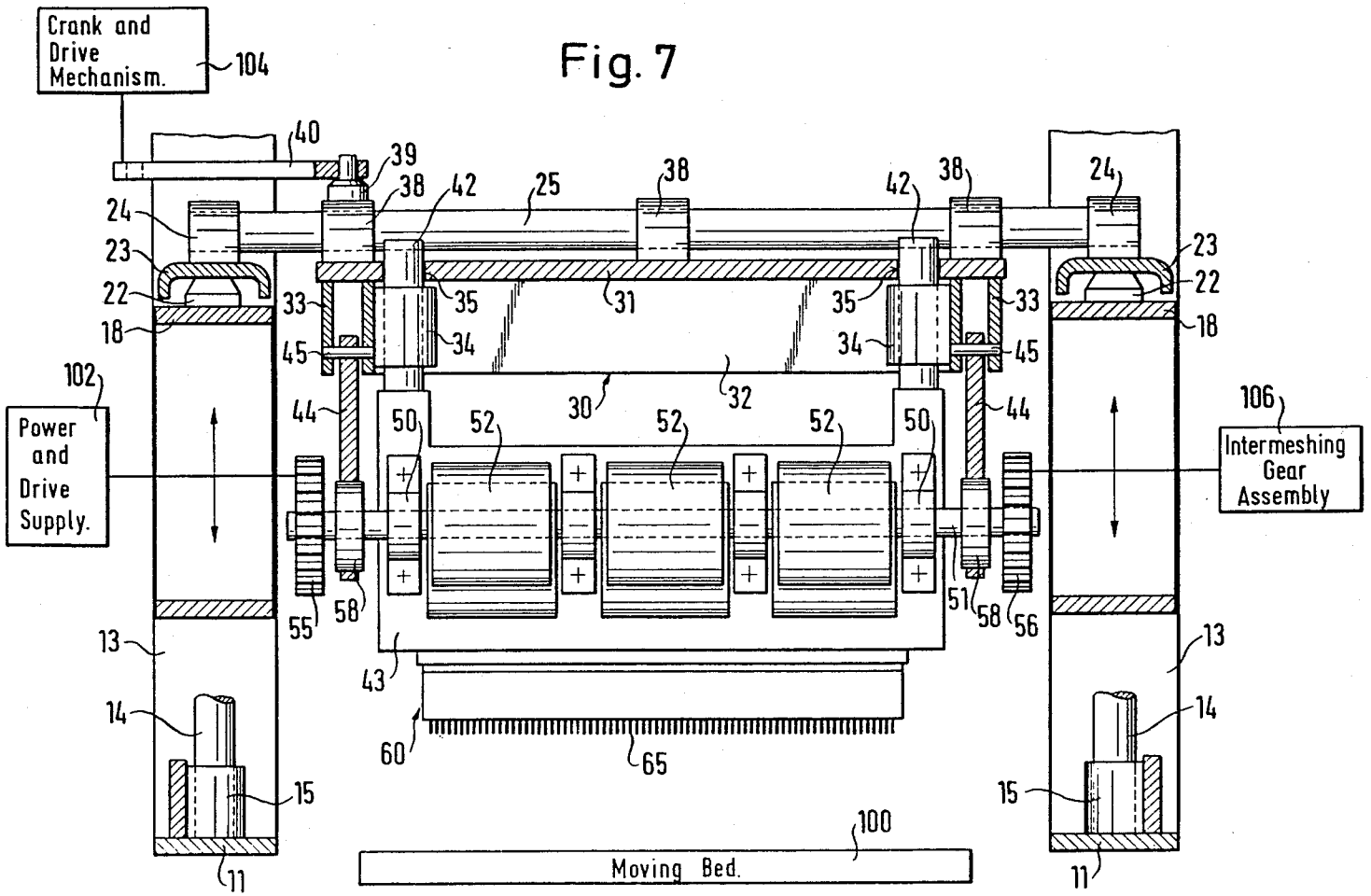
FIG. 7 is a similar to FIG. 1 but additionally shows support device for the invention.

FIG. 7 shows the embodiment of FIGS. 1–4 provided with associated support devices. Thus, in FIG. 7, and shown a moving bed device 100 for transporting stone to be worked relative to the stonecutting apparatus according to the invention, a power and drive supply 102 for driving flyweight shafts 51, crank and drive mechanism 104 for inducing a horizontal oscillatory movement in base carriage 30, and in intermeshing gear assembly 106 for providing for synchronous and opposite rotation of flyweight shaft 51.

The invention as described hereinabove in the context of the preferred embodiments is not to be taken as limited to all of the provided details thereof, since modifications and variations thereof may be made without departing from the spirit and scope of the invention.

What is claimed is:

1. Apparatus for stoneworking, said stoneworking apparatus comprising:

a base frame means;

means for providing relative translational movement in at least a first direction between said base frame means and a stone to be worked;

a swing frame being supported by said base frame means and being translatable with respect thereto;

said swing frame being translatable in a second direction with respect to the stone to be worked;

said at least a first direction and said second direction being substantially non-aligned;

said swing frame being provided with a tool block;

said tool block being provided with stoneworking tool mounting means for mounting a plurality of stoneworking tools in said tool block;

oscillating movement means for imparting an oscillating movement to said swing frame along said second direction which is toward the stone and away from the stone so as to provide movement of said tool block and impinge said tool block against the stone to be worked;

said oscillating movement means including movable weighted components;

said movable weighted components being disposed for producing resultant forces on said swing frame which are substantially solely along said second direction toward the stone and away from the stone; and mechanical power source means for powering and driving said oscillating movement means.

2. The stoneworking apparatus according to claim 1, further comprising weighted striking means for said plurality of stoneworking tools for respectively imparting an individual striking force to each of said stoneworking tools of said plurality of stoneworking tools in response to said oscillating movement.

3. The stoneworking apparatus according to claim 1, further comprising:

at least one pair of rotatable flyweight shafts, each of said flyweight shafts having mounted thereon at least one flyweight eccentrically weighted with respect to said flyweight shaft and means for driving said pair of flyweight shafts synchronously and in opposite rotational directions;

two paired sets of connecting rods, each set comprising at least two connecting rods, each of said at least two connecting rods in each of said sets having a first end which is pivotally connected to said base frame means, the second ends of said at least two connecting rods of each of said sets being repectively connected to said pair of flyweight shafts through eccentric crank members; and at least a pair of rotational bearings fixed to said swing frame, each of said pair of flyweight shafts engaging one of said pair of rotational bearings, respectively.

4. The stoneworking apparatus according to claim 3, wherein each of said eccentric crank members comprises a disc member provided with an eccentric connection to said respective flyweight shaft, said disc member being rotatably connected to said second end of said respective connecting rod.

5. Apparatus for stoneworking, said stoneworking apparatus comprising:

a base frame;

a swing frame being supported by said base frame and being relatively transversely displaceable with respect to said a surface of a stone;

said swing frame being provided with a tool block;

said tool block being provided with plural stoneworking tool mounting means for mounting a plurality of stoneworking tools in said tool block;

positively driven oscillating movement means for imparting a driven oscillating movement to said swing frame for driving said swing frame positively toward the stone to be worked so as to provide movement of said tool block and impinge said tool block against the surface of the stone;

striking means for said plurality of stoneworking tools for respectively imparting an individual striking force to each of said plurality of stoneworking tools in response to said positively driven oscillating movement; and said striking means including a multiplicity of weighted striking pins respectively aligned with said each of said plurality of stoneworking tools for providing said individual striking force thereto.

6. The stoneworking apparatus according to claim 5, further comprising a base carriage supported by said base frame, said base carriage being transversely displaceable with respect to said base frame, and wherein said swing frame is supported by said base carriage and is displaceable in an upwardly and downwardly direction with respect thereto.

7. The stoneworking apparatus according to claim 6, wherein the range of transverse displacement of said base carriage with respect to said base frame is at least one half the transverse distance adjacent stoneworking tools of said plurality of stoneworking tools.

8. The stoneworking apparatus according to claim 6, further comprising vertical adjustment means for adjusting the vertical positioning of said base carriage with respect to said base frame.

9. The stoneworking apparatus according to claim 8, wherein said vertical adjustment means comprises a vertically adjustable carriage, wherein said base carriage is horizontally displaceable along at least one shaft member supported by said vertically adjustable carriage, and further comprising shock absorbing bearing means for reducing the transmission of shock between said at least one shaft member and said vertically adjustable carriage.

10. The stoneworking apparatus according to claim 6, wherein said positively driven oscillating movement means comprises:

at least a first rotatable flyweight shaft having mounted thereon at least one flyweight eccentrically weighted with respect to said first rotatable flyweight shaft and means for driving said first rotatable flyweight shaft; and rotational to linear conversion means for converting the rotational movement of said driven at least one first rotatable flyweight shaft to substantially linear movement and for imparting said substantially linear movement to said swing frame.

11. The stoneworking apparatus according to claim 10, wherein said rotational to linear conversion means comprises at least one connecting rod, a first end of said connecting rod being pivotally connected to said base carriage and a second end of said connecting rod engaging said first rotatable flyweight shaft through an eccentric crank member, and at least one rotational bearing fixed to said swing frame, said first rotatable flyweight shaft engaging said at least one rotational bearing.

12. The stoneworking apparatus according to claim 11, wherein said eccentric crank member comprises a disc member provided with an eccentric connection to said first rotatable flyweight shaft, said disc member being rotatably connected to said second end of said at least one connecting rod.

13. The stoneworking apparatus according to claim 5, wherein said tool block comprises a block member provided with a multiplicity of throughgoing holes in a grid pattern, and wherein said striking means comprises said multiplicity of weighted striking pin members and a multiplicity of prestressed springs engaging therewith which are correspondingly and respectively located in said multiplicity of holes.

14. The stoneworking apparatus according to claim 13, further comprising cover means for covering said multiplicity of holes and for applying said prestress to said multiplicity of springs.

15. The stoneworking apparatus according to claim 13, wherein said tool block is adapted for mounting stoneworking tools having an enlarged head portion, said throughgoing holes being substantially stepped in diameter and having internal countersunk depressions for accepting said enlarged head portions.

16. The stoneworking apparatus according to claim 15, wherein said tool block has an external working surface for opposing the surface of the stone to be worked and through which said stoneworking tools protrude, and wherein each of said multiplicity of holes is provided with an external countersunk depression on said external working surface, such that said internal and said external countersunk depressions are spaced from one another and interconnected by a bore of a diameter substantially equal to the external diameters of said stoneworking tools.

17. The stoneworking apparatus according to claim 13, wherein said grid pattern comprises at least four rows of said throughgoing holes, each of said rows having at least twenty of said throughgoing holes substantially equally spaced, and wherein adjacent rows of said throughgoing holes are offset from one another by about $\frac{1}{3}$ to about $\frac{1}{4}$ of said substantially equal spacing between said holes.

18. The stoneworking apparatus according to claim 17, wherein said grid pattern comprises at least eight rows of at least 25 of said throughgoing holes each.

19. The stoneworking apparatus according to claim 5, wherein the range of transverse displacement of said swing frame with respect to said the surface of the stone is at least one half the transverse distance between adjacent stoneworking tools of said plurality of stoneworking tools.

20. Apparatus for stoneworking, said stoneworking apparatus comprising:

base frame means;

a swing frame being supported by said base frame means;

said swing frame being provided with a tool block;

said tool block being provided with plural stoneworking tool mounting means for mounting a plurality of stoneworking tools in said tool block;

oscillating movement means for imparting an oscillating movement to said swing frame relative to said base frame means for driving said swing frame toward a stone to be worked so as to provide movement of said tool block and impinge said tool block against the surface of the stone;

a plurality weighted striking means mounted in said tool block; and each of said weighted striking means being respectively aligned with each of said plurality of stoneworking tools for respectively imparting an individual striking force to said each of said plurality of stoneworking tools in response to said oscillating movement.

* * * * *